US007152994B2

(12) United States Patent
Huang

(10) Patent No.: US 7,152,994 B2
(45) Date of Patent: Dec. 26, 2006

(54) LED FLASHLIGHT

(76) Inventor: Joseph Huang, No. 8, Lane 42, Sec. 2, Nan-Kan Road, Lou-Choo Hsiang, To-Yuan Hsien (TW)

( * ) Notice: Subject to any disclaimer, the term of this patent is extended or adjusted under 35 U.S.C. 154(b) by 171 days.

(21) Appl. No.: 11/014,180

(22) Filed: Dec. 17, 2004

(65) Prior Publication Data

US 2006/0133075 A1 Jun. 22, 2006

(51) Int. Cl.
*F21L 4/00* (2006.01)

(52) U.S. Cl. ..... 362/205; 362/206; 362/202

(58) Field of Classification Search ..... 362/205, 362/202, 203, 204, 206, 208, 109, 118, 157, 362/184, 187, 197, 800, 802; 200/60, 310
See application file for complete search history.

(56) References Cited

U.S. PATENT DOCUMENTS 5,091,611 A * 2/1992 Reeves et al. ..... 362/208
5,629,105 A * 5/1997 Matthews ..... 362/205
6,398,383 B1 * 6/2002 Huang ..... 362/202

* cited by examiner

*Primary Examiner*—John Anthony Ward
*Assistant Examiner*—Bao Q. Truong
(74) *Attorney, Agent, or Firm*—Troxell Law Office, PLLC

(57) ABSTRACT

An LED flashlight having a structure of switch for which the housing of the flashlight comprises a cylinder and a rotating member mutually connected by means of an outer and an inner screw thread section, the cylinder and the rotating member thus rotate relatively to each other. When the rotating member so rotates, it moves an elastic piece having a number of P typed arms; the inner wall of the cylinder has at a position contacting protruding portions of the P typed arms an annular recess. When in circuit breaking of the flashlight, the protruding portions of the arms are exactly located in the annular recess and thereby is in a state of none contact; and when the rotating member rotates relatively to the cylinder, the rotating member moves the elastic piece axially to make the protruding portions move over the annular recess to contact the inner wall, thus the LED is turned on to emit light for illumination. With the design of the switch having the annular recess and the protruding portions of the P typed arms, illuminating and extinguishing of the flashlight can get controlled just by slightly rotating the rotating member.

13 Claims, 9 Drawing Sheets

LED FLASHLIGHT

BACKGROUND OF THE INVENTION

1. Field of the Invention

The present invention is related to an LED flashlight, and especially to a structure of switch of the LED flashlight for controlling turning on/off of an LED within an extremely short stroke by taking advantage of relative rotation of a rotating member to a cylinder.

2. Description of the Prior Art

Following advancing of the technique of light emitting diodes (LED), luminosity of an LED now is adequate to be used for illumination, and such an LED with high luminance has the advantage of saving electricity as well as being not heat emissive, hence a tendency has been existing to use LEDs in lieu of traditional flashlights.

Normal LED flashlights mostly each has a battery in a cylinder, and the front end of a cylinder is provided with an LED socket, turning on/off of an LED is controlled by rotation of a cover on an end of the cylinder or pressing of a push button on the cylinder, and then illuminating and extinguishing of each flashlight can get controlled.

In prior arts, a press switch must be added on a cylinder; thereby cost of production of flashlights is largely increased and thus is uneconomic.

Alternatively, in the prior arts, there is also the way of relative rotation of a cover or a cylinder to control turning on/off of a flashlight. However, this is to control turning on/off of a circuit just by contact or none contact of a spring in the cover with a negative electrode of the battery. Because that the battery must be pressed by the spring, operation of rotation controlling turning on/off of a flashlight in the prior arts can only separate or make contact of the spring from/with the battery by a quite long stroke of rotation; and such operation is very inconvenient; while if the spring does not press the battery and forms a broken circuit, the battery is loosed and will be staggered.

Particularly, when in urgent lightening, such as during being abruptly cut out from electric power, such long-stroke rotation can not lighten a flashlight at once and thus has its defect in use.

Obviously, operation of a conventional LED flashlight only has one mode and can not satisfy the requirement of fast lightening. Therefore, it is necessary to provide a novel structure to overcome the defect of the conventional technique.

SUMMARY OF THE INVENTION

The main object of the present invention is to provide an LED flashlight having a structure of switch for which the housing of the flashlight comprises a cylinder and a rotating member mutually connected by means of an outer screw thread section and an inner screw thread section, the cylinder and the rotating member thus can rotate relatively to each other; when the rotating member rotates relatively to the cylinder, it can move an elastic piece having a number of P typed arms; the inner wall of the cylinder is provided at a position contacting protruding portions of the P typed arms with an annular recess. When in circuit breaking of the flashlight, the protruding portions of the P typed arms are exactly located in the annular recess of the cylinder and thereby is in a state of none contact; and when the rotating member rotates relatively to the cylinder, the rotating member moves the elastic piece axially to make the protruding portions of the P typed arms contact with the inner wall of the cylinder, thus the LED is turned on to emit light for illumination. With the design of the switch having the annular recess and the protruding portions of the P typed arms, illuminating and extinguishing of the flashlight can get controlled just by slightly rotating the rotating member.

By virtue that the spring of the present invention always presses a battery, so that when the flashlight is turned off, the battery is kept in its fixed positions without moving.

With such a structure of switch, various types of flashlight can be further obtained after designing.

For example, the rotating member can be on the rear of the flashlight. The front section of the cylinder can have an LED circuit board, the middle section can receive the battery of which the positive electrode is connected with a first electrode of the circuit board, while the front section of the electric conductive cylinder can be connected with a second electrode of the circuit board; the rotating member can be fitted therein with a seat, the seat receives a conical spring and is provided with an elastic piece having P typed arms, the front end of the conical spring presses against the negative electrode of the battery and contacts the elastic piece; thereby a structure that the rotating member is on the rear of the flashlight can be obtained.

In this embodiment, an end of the seat can be extended out of the rotating member to form a pressing portion that can be directly pressed to displace the elastic piece axially to make the protruding portions of the P typed arms contact with the inner wall of the cylinder, thus the LED is turned on to emit light. Especially when in urgent state of use, the LED can be lightened without rotating the rotating member, and can be used for signal emitting by illuminating and extinguishing under control.

Surely, the rotating member can also be designed to be in the front of the flashlight; it is provided therein with a seat for the LED, the seat is provided with an elastic piece having P typed arms; the cylinder receives a battery of which the positive electrode is connected with a first electrode of the circuit of the LED, a second electrode of the LED is connected with the elastic piece. In this mode, a structure that the rotating member is in the front of the flashlight can be obtained.

The present invention will be apparent in its structural features and effects of operation after reading the detailed description of the preferred embodiment thereof in reference to the accompanying drawings.

DETAILED DESCRIPTION OF THE PREFERRED EMBODIMENT

Figure 1:
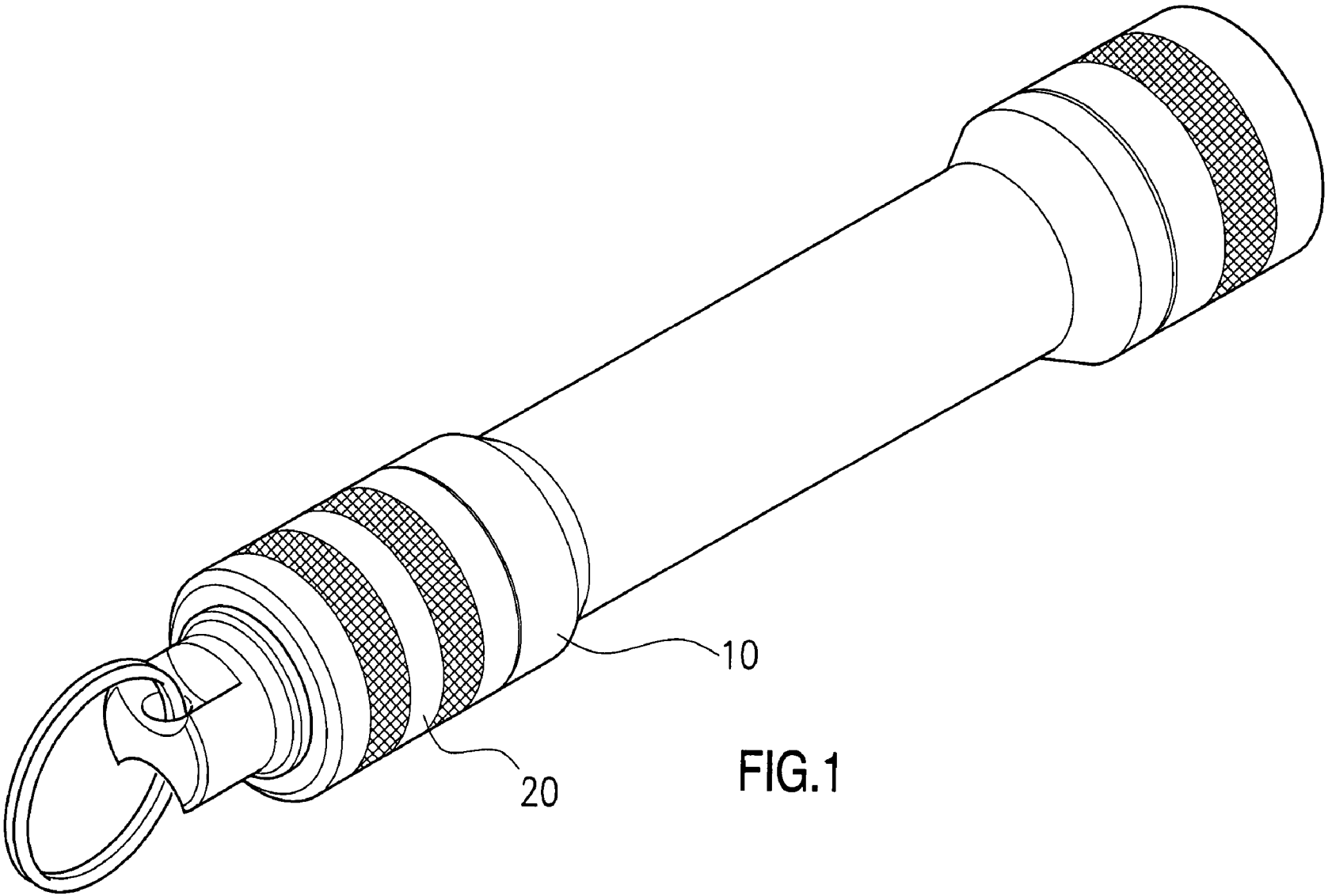
FIG. 1 is a perspective view showing the appearance of a first embodiment of the present invention, in which the rotating member is on the rear of the flashlight.
Figure 2:
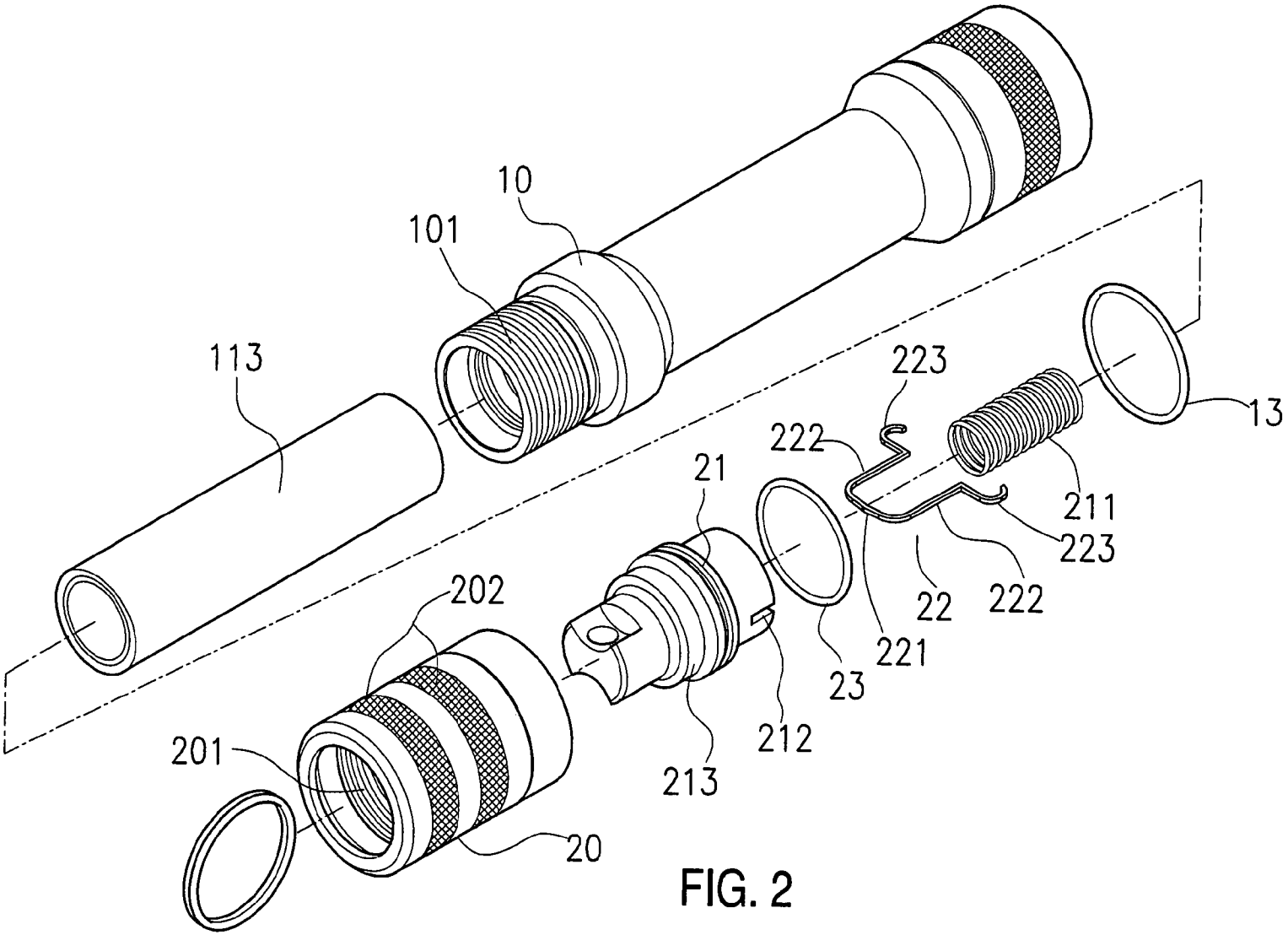
FIG. 2 is an analytic perspective view of the embodiment of FIG. 1.
Figure 3:
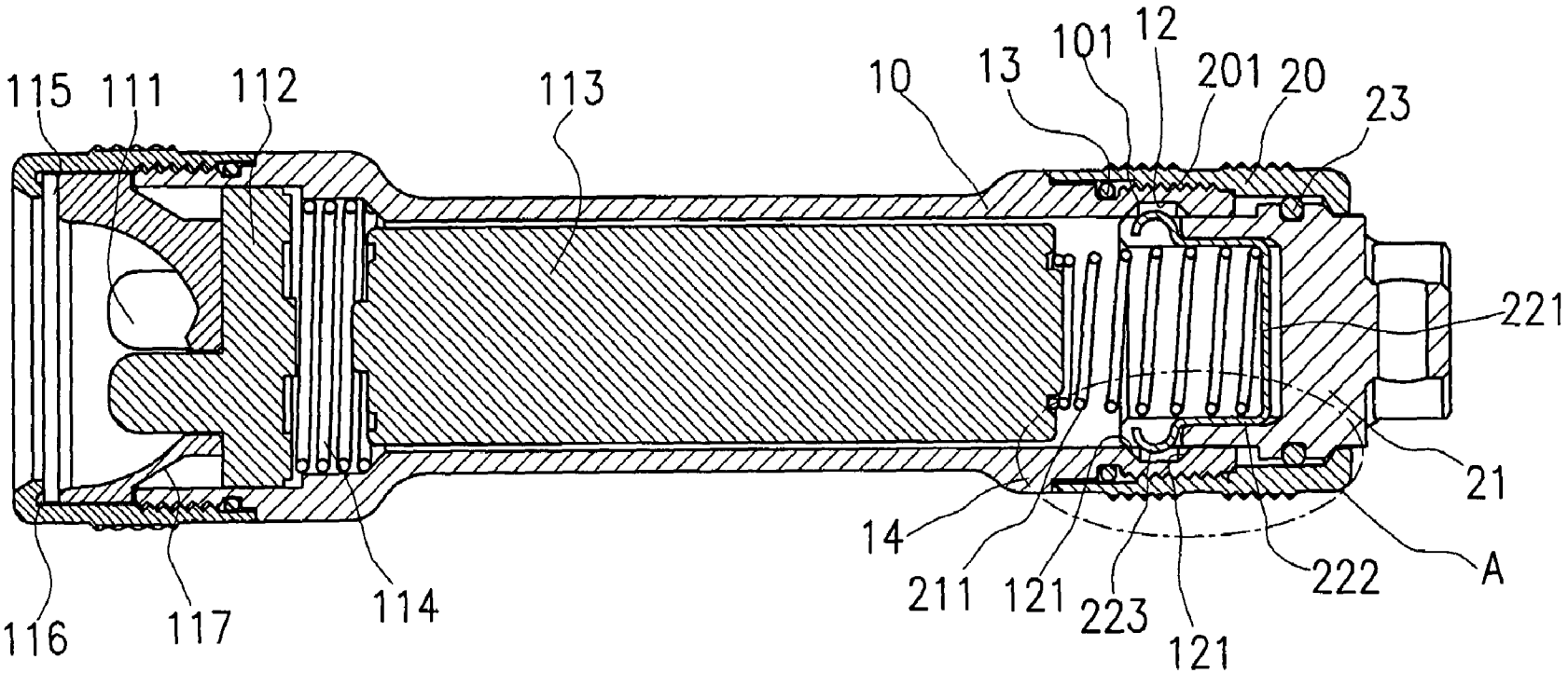
FIG. 3 is a sectional view of the embodiment of FIG. 1.

Referring firstly to FIGS. 1–3 showing a first embodiment of the present invention in which a rotating member is on the rear of a flashlight, a housing of the flashlight comprises a cylinder 10 and the rotating member 20; the cylinder 10 has an outer screw thread section 101, and the rotating member 20 has an inner screw thread section 201, the two sections can be thread connected with each other.

Referring to FIG. 3, a front section of the cylinder 10 receives an electric circuit board 112 having an LED 111, a middle section receives a battery 113 of which the positive electrode is connected with a first electrode of the electric circuit board 112, the first electrode as shown in the drawing is a spring 114 extending rearwards from the electric circuit board 112; and the front section of the cylinder 10 is provided with a front cover 115, a light transmitting plate 116 and a light reflective plate 117 etc. A second electrode of the circuit board 112 is connected with the electric conductive cylinder 10.

Referring to FIGS. 2 and 3, the rotating member 20 can be fitted therein with a seat 21, the seat 21 is a hollow cylinder and receives a conical spring 211 and is provided with an elastic piece 22. The front end of the conical spring 211 presses against the negative electrode of the battery 113 in the cylinder 10, and the rear end of the conical spring 211 contacts the elastic piece 22.

Figure 3A:
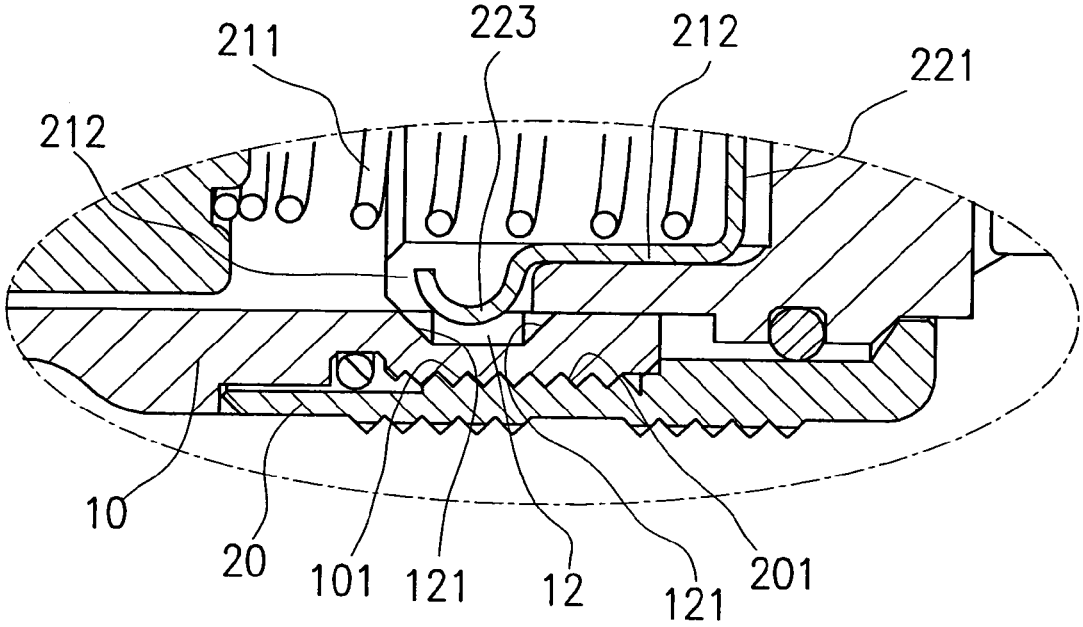
FIG. 3A is an enlarged sectional view showing an "A" part in FIG. 3.

The elastic piece 22 comprises two mutually opposite P typed arms 222 and a connecting section 221. The connecting section 221 connects the two P typed arms 222 and contacts the rear end of the conical spring 211 for electric connection. The front ends of the P typed arms 222 form protruding portions 223. When the elastic piece 22 is mounted on the seat 21, the protruding portions 223 are exactly located in a notch 212 provided on the front end of the seat 21, and at least parts of the protruding portions 223 are extended over the outer wall of the seat 21, please refer to FIG. 3A.

The position that the inner wall of the cylinder 10 contacts with the protruding portions 223 is provided with an annular recess 12. Width of the annular recess 12 is slightly larger than the section of the protruding portions 223 of the elastic piece 22 extending over the outer wall of the seat 21, thereby when in circuit breaking, the protruding portions 223 are exactly located in the annular recess 12 without contacting the inner wall of the cylinder 10, such as is shown in FIG. 3.

Figure 4:
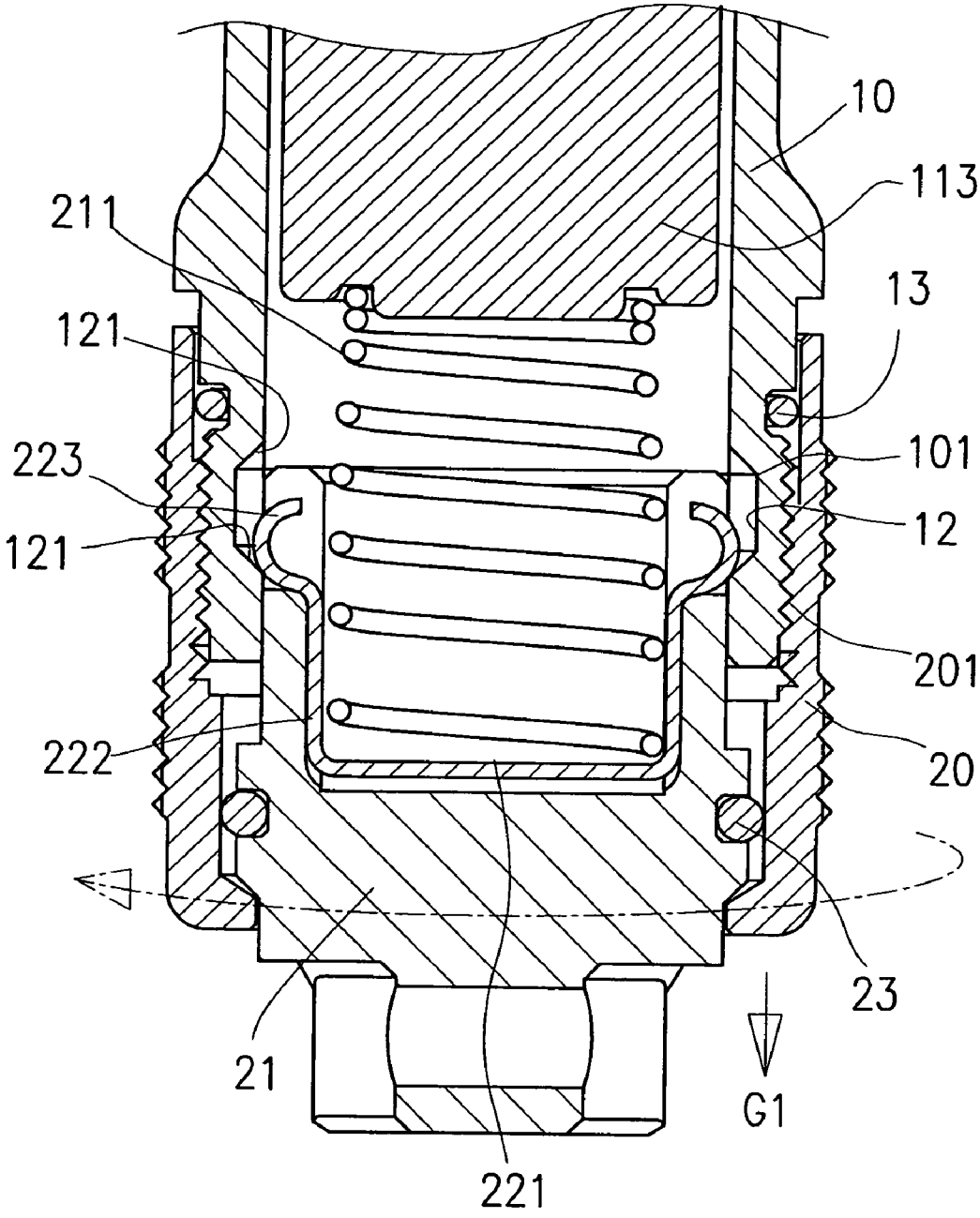
FIG. 4 is a sectional view of the embodiment of FIG. 1, in which the rotating member is rotated to turn on the LED for illumination.

Referring to FIG. 4, when the rotating member 20 is given a rotating force to rotate relatively to the cylinder 10 and moves axially as is shown by the arrow G1, by a pushing force provided by the conical spring 211, the seat 21 moves axially too, and also the elastic piece 22 in the seat 21 moves axially to make the protruding portions 223 on the front ends of the P typed arms contact with the inner wall of the cylinder 10. At this time, by contact of the conical spring 211 with the negative electrode of the battery 113, the circuit of the LED 111 is turned on to emit light for illumination.

With such a structure of switch, because that the width of the annular recess 12 is not large, a user needs only to slightly rotate the rotating member 20 for fast turning on the LED 111 to emit light for illumination.

When it is desired to cut the circuit connection as shown in FIG. 4, it needs only to reversely turn the rotating member 20 to render the protruding portions 223 of the elastic piece 22 to get back into the annular recess 12 of the cylinder 10 to make the protruding portions 223 not contact with the inner wall of the cylinder 10, and the broken circuit state as shown in FIG. 3 restores.

Figure 5:
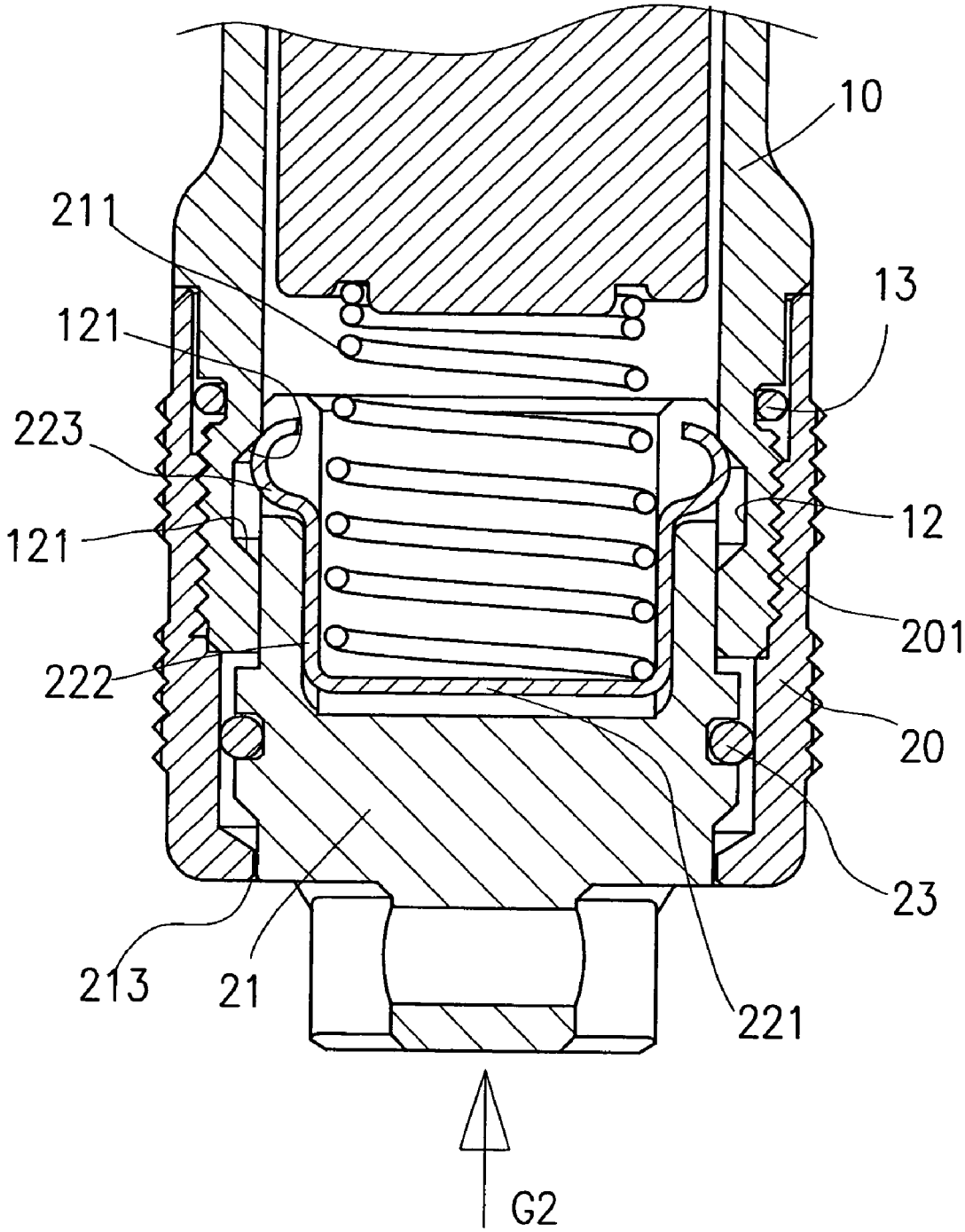
FIG. 5 is a sectional view of the embodiment of FIG. 1, in which a seat is pressed to turn on the LED.

Further referring to FIG. 5, a pressing portion 213 being on an end of the seat 21 and extending out of the lateral wall of the rotating member 20 is given a pressing force as shown by the arrow G2, and the seat 21 can displace the elastic piece 22 axially to make the protruding portions 223 of the elastic piece 22 move forwards to contact the inner wall of the cylinder 10, thus the LED is turned on to emit light for illumination. With the design of the switch, the function of emitting light for illumination can be performed with a single hand of the user in urgent use; and this can render convenient of the action of signal emitting by illuminating and extinguishing; at this time, the rotating member 20 is fixed and unmoved.

The two lateral sides of the annular recess 12 are designed to have inclined surfaces 121 for the convenience of contacting and leaving of the protruding portions 223 (which are arciform) of the elastic piece 22.

The rotating member 20 is provided on the outer surface thereof with coarse embossments 202 in favor of rotating by the user.

The joint for screw connecting of the rotating member 20 with the cylinder 10 and the connecting area of the seat 21 with the rotating member 20 are respectively provided with washers 13 and 23 for water-proofing.

Referring again to FIG. 3, the cylinder 10 is provided thereon with a stop area 14, the protrusion of the stop area 14 is for stopping the end of the rotating member 20, for the purpose that the stop area 14 stops the rotating member 20 against rotation, and the protruding portions 223 of the elastic piece 22 are exactly located in the annular recess 12 of the cylinder 10 to form circuit breaking. With such a design, the user can rotate the rotating member 20 to the endmost accurately to control the circuit breaking state of the flashlight. And when in lightening, it needs only to slightly rotate the rotating member 20 to make the protruding portions 223 of the elastic piece 22 contact with the inner wall of the cylinder 10, thus the LED is turned on to emit light.

Figure 6:
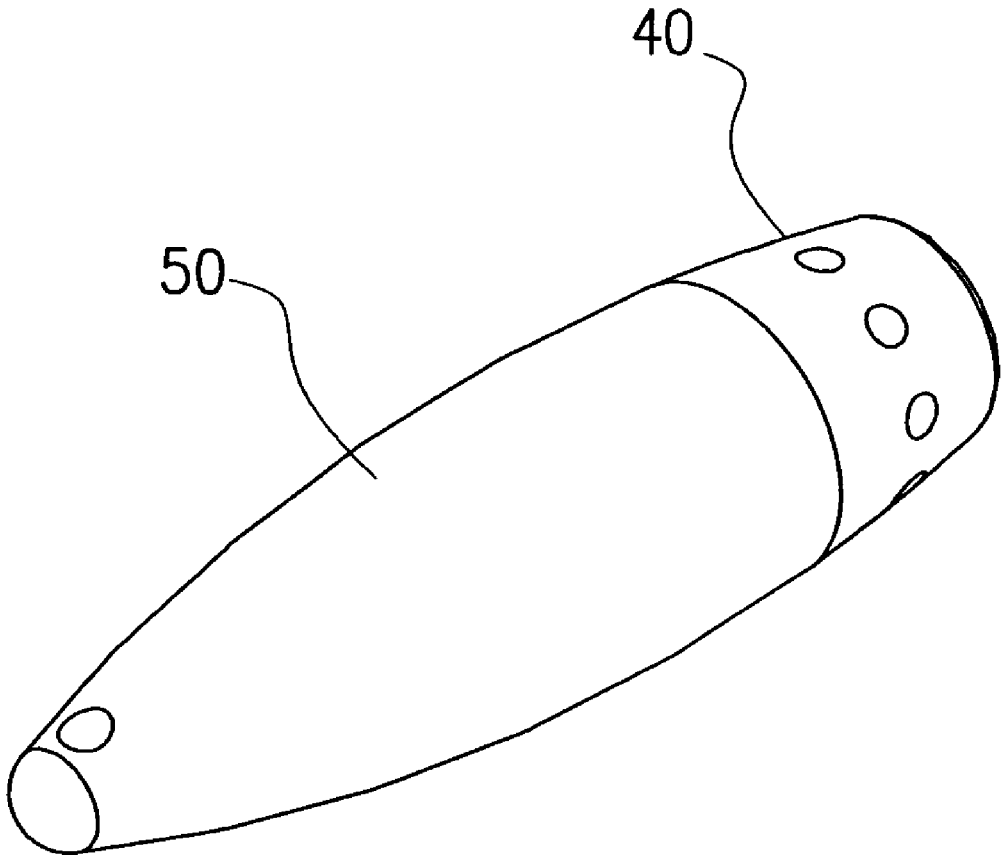
FIG. 6 is a perspective view showing the appearance of a second embodiment of the present invention, in which the rotating member is in the front of the flashlight.
Figure 7:
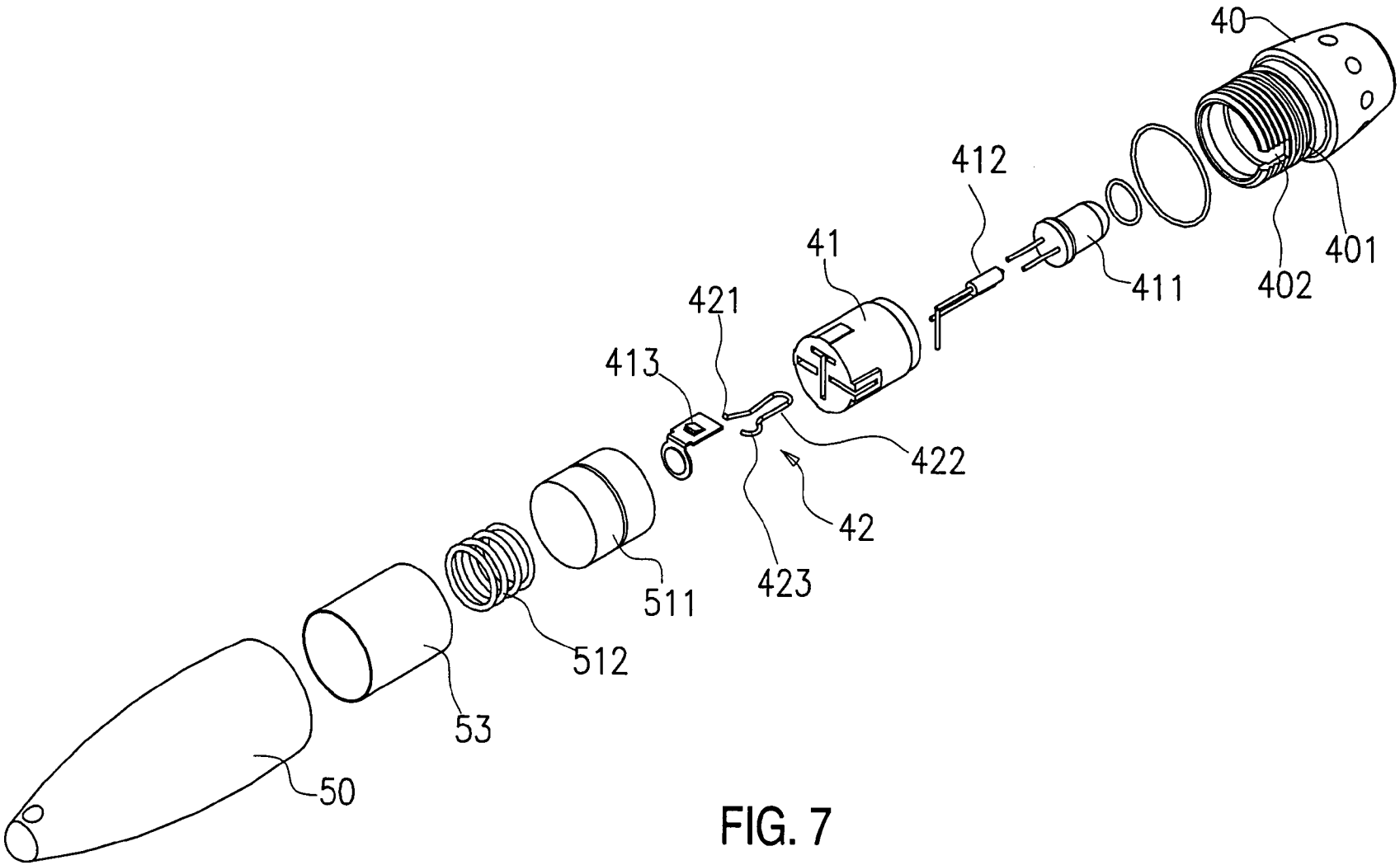
FIG. 7 is an analytic perspective view of the embodiment of FIG. 6.
Figure 8:
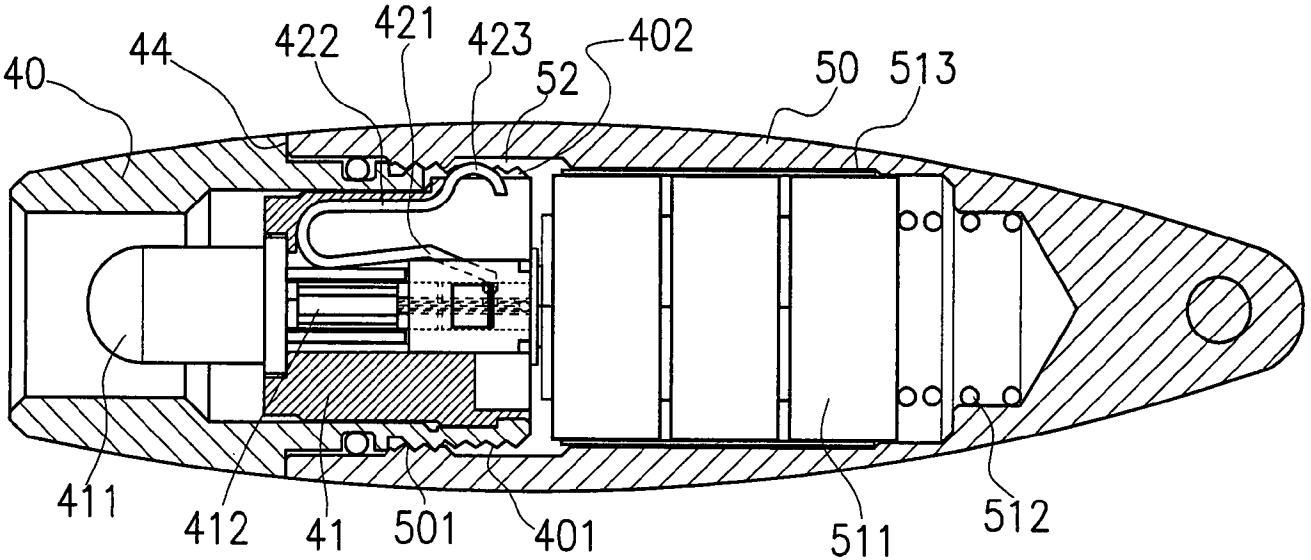
FIG. 8 is a sectional view of the embodiment of FIG. 6.

Referring to FIGS. 6–8 showing another embodiment of the present invention, in which a rotating member 40 is in the front of the flashlight, while a cylinder 50 is on the rear of the flashlight.

The rotating member 40 has an outer screw thread section 401, and the cylinder 50 has an inner screw thread section 501, the two sections 401 and 501 are thread connected with each other.

The cylinder 50 has therein a battery 511 and a spring 512. The battery 511 is placed in an insulating body 513 of the cylinder 50. A negative electrode of the battery 511 contacts the spring 512, so that the cylinder 50 can be electrically conductive.

The rotating member 40 is provided therein with a seat 41, the seat 41 is provided thereon with an LED 411 and an electronic element 412; the circuit of the LED 411 forms a first electrode which is an electrode plate 413 in the drawing and is connected with the positive electrode of the battery 511. An elastic piece 42 is mounted on the seat 41 comprises a P typed arm 422 and a connecting foot 421 in connecting with a second electrode of the circuit of the LED 411. An end of the P typed arm 422 is formed a protruding portion 423.

After assembling, referring to FIG. 8, the protruding portion 423 at least has a part extending over a cut 402 on the rotating member 40.

An annular recess 52 is provided at a contact position on the inner wall of the cylinder 50 with the protruding portion 423 on one lateral side of the elastic piece 42, when in circuit breaking, the protruding portion 423 of the elastic piece 42 is exactly located in the annular recess 52 without contact with the inner wall of the cylinder 50 to render the LED to form circuit breaking.

Figure 9:
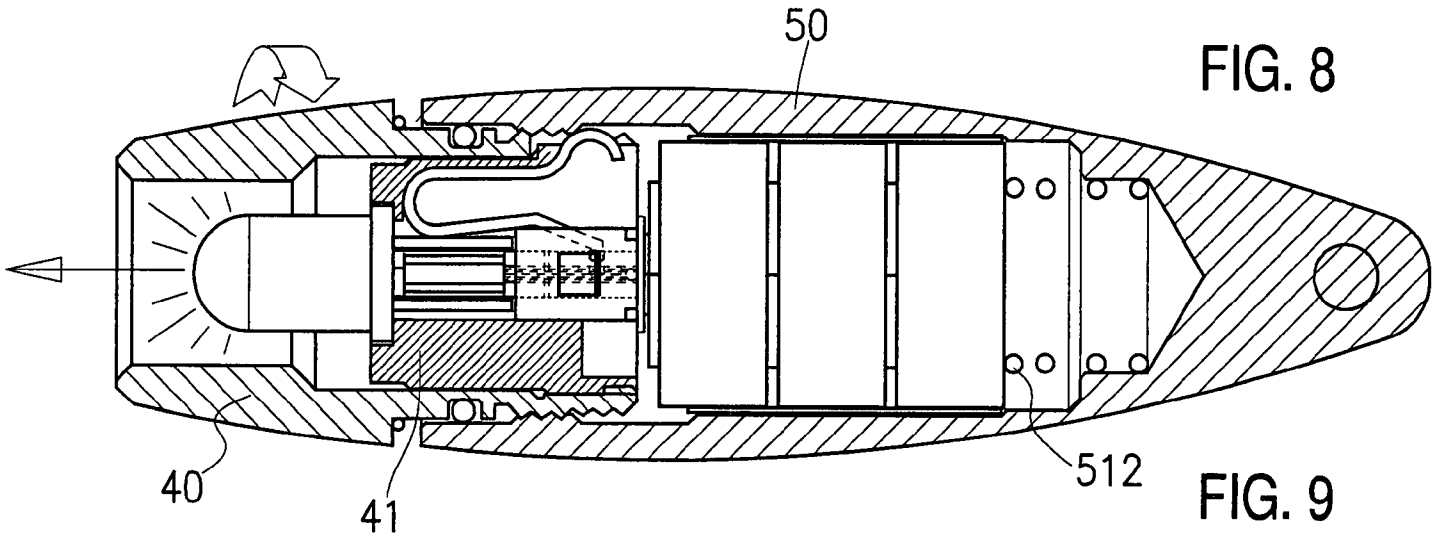
FIG. 9 is a sectional view of the embodiment of FIG. 6, in which the rotating member is rotated to turn on the LED for illumination.

Referring to FIG. 9, when the rotating member 40 is given a rotating force to rotate relatively to the cylinder 50 and moves axially as is shown by the arrow G3, by a pushing force provided by the spring 512, the seat 41 moves axially too, and also the elastic piece 42 in the seat 41 moves axially to make the protruding portion 423 on the front end of the P typed arm move over the annular recess 52 to contact with the inner wall of the cylinder 50. At this time, by contact of the spring 512 with the negative electrode of the battery 511, the circuit of the LED is turned on to render the flashlight emit light for illumination. If it is desired to cut the circuit of the LED to turn off the flashlight, it needs only to rotate the rotating member 40 in a contrary direction to restore it to the position shown in FIG. 8 to render the protruding portion 423 of the elastic piece 42 to move back into the annular recess 52, and the state of circuit breaking is attained.

A stop area 44 is formed on the rotating member 40, the protrusion of the stop area 44 is for stopping the end of the rotating member 50, for the purpose that the stop area 44 stops the rotating member 40 against rotation, and the protruding portion 423 of the elastic piece 42 is exactly located in the annular recess 52 of the cylinder 50 to form circuit breaking. With such a design, the user can rotate the rotating member 40 to the endmost accurately to control the circuit breaking state of the flashlight. And when in lightening, it needs only to slightly rotate the rotating member 40 to make the protruding portion 423 of the elastic piece 42 contact with the inner wall of the cylinder 50, thus the LED is turned on to emit light.

This is another type of the present invention, of which the object is to reduce the volume of the entire LED flashlight. However, by virtue that the displacement of the protruding portion 423 of the elastic piece 42 relative to the inner wall of the cylinder 50 is very small, the user can control illuminating and extinguishing of the flashlight just by slightly rotating the rotating member 40.

The embodiments and drawings given are only for illustrating the present invention, and not for giving any limitation to the scope of the present invention; it will be apparent to those skilled in this art that various modifications or changes without departing from the spirit of this invention, such as interchanging between the outer and the inner screw thread sections, increasing or decreasing the amount of battery, moderation of the LED circuit etc., shall also fall within the scope of the appended claims.

The invention claimed is:

1. An LED flashlight comprising a housing having a cylinder and a rotating member mutually connected by means of an outer screw thread section and an inner screw thread section provided respectively on said cylinder and said rotating member, said cylinder and said rotating member are adapted to rotating relatively to each other; said housing of said flashlight has therein an LED circuit and a battery for supplying power; said flashlight is characterized in that:

said LED flashlight further comprises a structure of switch to make turning on/off of said LED circuit by rotating said rotating member relatively to said cylinder; said rotating member is provided thereon with an elastic piece having a number of P typed arms each with an end forming a protruding portion; when said rotating member rotates, said elastic piece moves axially; an inner wall of said cylinder is provided at a position contacting said protruding portions of said elastic piece with an annular recess; when in circuit breaking of said flashlight, said protruding portions of said elastic piece are exactly located in said annular recess of said cylinder and thereby is in a state of none contact; and when said rotating member rotates relatively to said cylinder, said rotating member moves said elastic piece axially to move said protruding portions over said annular recess and contact with said inner wall of said cylinder, thus said LED circuit is turned on to emit light for illumination.

2. The LED flashlight as in claim 1, wherein: said rotating member is provided on the rear of said flashlight, said cylinder is electric conductive and has said outer screw thread section, and said rotating member has said inner screw thread section; a front section of said cylinder receives said LED circuit, a middle section of said cylinder receives said battery of which a positive electrode is connected with a first electrode of said LED circuit, and a second electrode of said LED circuit is connected with said cylinder; said rotating member is fitted therein with a seat, said seat receives a conical spring and is provided with said elastic piece; a front end of said conical spring presses against a negative electrode of said battery in said cylinder, and a rear end of said conical spring contacts said elastic piece.

3. The LED flashlight as in claim 2, wherein: said front section of said cylinder is provided with a front cover, a light transmitting plate and a light reflective plate.

4. The LED flashlight as in claim 2, wherein: said elastic piece comprises two said P typed arms mutually opposite with each other and a connecting section, said connecting section connects said two P typed arms and contacts a rear end of said conical spring for electric connection.

5. The LED flashlight as in claim 4, wherein: a front end of said seat is provided with a notch, and at least parts of said protruding portions are extended over an outer wall of said seat to connect said inner wall of said cylinder.

6. The LED flashlight as in claim 2, wherein: a rear end of said seat is extended out of said rotating member to form a pressing portion that is pressed via said seat to displace said elastic piece axially to make said protruding portions of said elastic piece move axially and thereby to move said protruding portions and contact with said inner wall of said cylinder, thus said LED circuit is turned on to make said flashlight emit light for illumination.

7. The LED flashlight as in claim 1, wherein: two lateral sides of said annular recess have inclined surfaces, said protruding portions of said elastic piece are arciform.

8. The LED flashlight as in claim 1, wherein: said rotating member is provided on an outer surface thereof with coarse embossments.

9. The LED flashlight as in claim 2, wherein: said cylinder is provided with a stop area, a protrusion of said stop area is for stopping an end of said rotating member, for the purpose that said stop area stops said rotating member against rotation, and said protruding portions of said elastic piece are exactly located in said annular recess of said cylinder to form circuit breaking.

10. The LED flashlight as in claim 1, wherein: said rotating member is provided in the front of said flashlight, said rotating member has said outer screw thread section, and said cylinder has said inner screw thread section; said cylinder receives said battery and a spring, a negative electrode of said battery contacts said spring, and said cylinder is electrically conductive; said rotating member is provided therein with a seat, said seat is provided thereon with said LED circuit; a first electrode of said LED circuit is connected with a positive electrode of said battery; said elastic piece is mounted on said seat and comprises a P typed arm only and a connecting foot in connecting with a second electrode of said LED circuit.

11. The LED flashlight as in claim 10, wherein: said battery is placed in an insulating body of said cylinder.

12. The LED flashlight as in claim 10, wherein: said protruding portions of said elastic piece at least each has a part extending over a cut on said rotating member to contact said inner wall of said cylinder.

13. The LED flashlight as in claim 10, wherein: a stop area is formed on said rotating member, a protrusion of said stop area is provided for stopping an end of said rotating member, for the purpose that said stop area stops said rotating member against rotation; and when stopping rotation, said protruding portion of said elastic piece is exactly located in an annular recess of said cylinder to form circuit breaking.

* * * * *